United States Patent [19]

Wasser

[11] Patent Number: 4,966,652

[45] Date of Patent: Oct. 30, 1990

[54] INCREASING THE STIFFNESS OF PAPER

[75] Inventor: Richard B. Wasser, Norwalk, Conn.

[73] Assignee: American Cyanamid Company, Stamford, Conn.

[21] Appl. No.: 432,285

[22] Filed: Nov. 3, 1989

Related U.S. Application Data

[63] Continuation-in-part of Ser. No. 18,386, Feb. 25, 1987, abandoned.

[51] Int. Cl.[5] ..... D21H 17/38

[52] U.S. Cl. ..... 162/135; 162/158; 162/168.3; 162/175; 162/184

[58] Field of Search ..... 162/158, 168.3, 175, 162/135, 184; 427/391

[56] References Cited

U.S. PATENT DOCUMENTS

| | | | |
|---|---|---|---|
| 3,556,932 | 1/1971 | Coscia et al. | 162/168.3 |
| 3,840,489 | 10/1974 | Strazdins | 162/168.3 |
| 4,170,672 | 10/1979 | Moriya et al. | 162/168.3 |
| 4,217,425 | 8/1980 | Ballweber et al. | 162/168.3 |

*Primary Examiner*—Peter Chin

*Attorney, Agent, or Firm*—Frank M. Van Riet

[57] ABSTRACT

The stiffness of paper is enhanced by the addition thereto of a composition consisting essentially of an acrylamide polymer and glyoxal with or without starch.

12 Claims, No Drawings

INCREASING THE STIFFNESS OF PAPER

BACKGROUND OF THE INVENTION

In the manufacture of paper and paperboard, it is often desirable to add to the paper, after wet-web formation and generally during drying of the web, various compositions which impart to the resultant paper various desired properties. Thus, sizing agents, coatings, etc. are added to paper to render it more desirable for specific product applications.

Starch is often applied to paper at the size press, for example, to improve, among other properties, the stiffness of the paper. Stiffness is required where the paper is to be used, for example, in applications, such as container board, packaging papers and fine papers for subsequent ease in machine processing, such as sheet fed printers. In the past, starch and synthetic polymers, such as polyvinylalcohol have not proven- to be universally acceptable for the stiffening of paper because the desired stiffness improvement is not cost effective.

As a result, the search for methods and compositions for imparting stiffness to paper continues, the finding of which continues to satisfy a long felt need.

SUMMARY OF THE INVENTION

It has now been found that the stiffness of paper can be materially enhanced by incorporating therein an unreacted mixture of a water-soluble acrylamide polymer and glyoxal, with or without starch. The acrylamide polymer can be a homopolymer or a copolymer and can include other copolymerizable monomers so long as the final polymer is still water-soluble.

DESCRIPTION OF THE INVENTION INCLUDING PREFERRED EMBODIMENTS

The process of the present invention comprises (A) adding to paper an effective amount of a composition consisting essentially of an aqueous solution of (1) a water-soluble polymer of acrylamide and (2) glyoxal, the ratio, by weight, of (1):(2) ranging from about 90:10 to about 25:75, respectively, (B) drying the resultant paper and (C) recovering the resultant stiffened paper.

Component (1) comprises any acrylamide polymer, including a homopolymer, copolymer, terpolymer, etc., which is water-soluble and preferably has a molecular weight ranging from about 10,000 to about 5,000,000, preferably, from about 20,000 to about I,000,000. The acrylamide can be acrylamide per se, methacrylamide, N,N-dimethylacrylamide etc., and copolymers of any of these acrylamides with such comonomers as acrylic acid, methacrylic acid, acrylamidopropane sulfonic acid, dimethylaminoethyl acrylate and the like, and can include terpolymers with such other comomoners which are known to polymerize with the acrylamides including non-water soluble comonomers such as the acrylic and methacrylic esters, acrylonitrile, styrene etc. in such amounts that the final polymers, however, are water-soluble. Preferred polymers are polyacrylamide and copolymers of acrylamide and acrylic acid at molar ratios of about 99:01 to about 50:50, respectively.

The preferred ratio, by weight, of Component (1) to Component (2) is from about 80:20 to about 40:60, respectively. An even more preferred ratio is about 50:50, respectively.

The above described composition is applied to paper as an aqueous solution thereof, preferably at the size press of the paper-making machine and not at the wet end thereof as with wet and dry strength additives. Effective amounts of the composition are applied with from about 0.5% to about 15%, by weight, based on the weight of the paper, preferably from about 2% to about 8%, being preferred.

Glyoxal is employed as the second critical component of the compositions used herein and is preferred, although any material which functions to liberate glyoxal or any derivative of glyoxal may be employed in its stead. Glyoxalated acrylamide polymers do not fall within the scope of the term "glyoxal", as used herein.

Starch may be used in conjunction with the compositions used herein in amounts ranging from about 0% to about 95%, by weight, based on the weight of the composition, preferably, from about 50% to about 90%, same basis.

Small amounts of other additives such as pigments, clays, coloring agents, etc., i.e., up to about 5.0%, by weight, based on the total weight of the compositions, may also be added.

As applied to paper in accordance with the method of the present invention, the above-described compositions impart stiffness to paper to a greater degree than the acrylamide polymer alone, the glyoxal alone, starch alone or any other combinations of these components.

The term "paper", as used herein, is meant to include any cellulosic fiber containing web or mat which is prepared by drawing down a dilute aqueous cellulose fiber suspension which may contain other fibrous matter such as glass fiber, polyamide fiber, viscose fiber and the like.

Compositions somewhat related to those employed in the novel process hereof are disclosed in U.S. Pat. No. 2,616,818, however, the compositions disclosed therein and the use in paper contain large amounts of clay and are finally contained on the paper as coatings whereas the compositions applied to paper in accordance with the process of the present invention are absorbed into the paper surface, i.e., they penetrate into the actual body of the paper.

After applying the compositions onto the paper in accordance with the method discussed above, the paper is further dried to normal papermaking conditions, usually 2–8%, and the resultant dried paper is then ready for use.

The following examples are set forth for purposes of illustration only and are not to be construed as limitations on the present invention except as set forth in the appended claims. All parts and percentages are by weight unless otherwise specified.

EXAMPLE 1

A dry paper web produced from an aqueous slurry of cellulosic paper-making fibers is immersed in an aqueous solution of an unreacted mixture of a copolymer of acrylamide and acrylic acid (90/10) having a molecular weight of 200,000 and glyoxal. The ratio, by weight, of polymer to glyoxal is 50:50. The solution contains no reaction product of the acrylamide polymer and the glyoxal. The resultant paper is dried and tested for stiffness after equilibrating in an atmosphere at 73° F. and 50% relative humidity. The results are set forth in Table I, below.

EXAMPLES 2–5

Following the procedure of Example 1, the following materials are added to the paper at the size press in corresponding amounts:

Example 2. 100% glyoxal

Example 3. 100% copolymer

Example 4. 90% starch; 10% composition of Example 1

Example 5. 100% starch.

The resultant are set forth in Table 1, below.

TABLE 1

| Composition of | Specific Tensile Stiffness (in millions) (in.) | Total Solids Pick-Up (%) |
|---|---|---|
| Example 1 | 22.4 | 0.50 |
| | 24.3 | 1.20 |
| | 25.6 | 2.80 |
| | 29.8 | 6.20 |
| Example 2 | 22.3 | 0.50 |
| | 23.0 | 1.20 |
| | 24.3 | 2.70 |
| | 26.1 | 5.8 |
| Example 3 | 23.0 | 0.50 |
| | 23.3 | 1.20 |
| | 23.9 | 2.80 |
| | 25.5 | 7.0 |
| Example 4 | 20.5 | 0.50 |
| | 22.6 | 1.30 |
| | 23.7 | 2.90 |
| | 24.5 | 7.50 |
| Example 5 | 21.1 | 0.60 |
| | 20.2 | 2.35 |
| | 22.0 | 2.90 |
| | 22.1 | 8.0 |

The water-treated control is 20.1 Specific Tensile Stiffness.

EXAMPLES 6–9

The procedure of Example 1 is again followed except that 60/40 blends of the compositions are employed as follows:

Example 6-60/40 blend of starch and the composition of Example 1.

Example 7-60/40 blend of starch and the copolymer of Example 1.

Example 8-60/40 blend of starch and glyoxal.

Example 9-100 % starch.

The results are set forth in Table II, below.

TABLE II

| Composition of | Specific Tensile Stiffness (in millions) (in.) | Total Solids Pick-Up (%) |
|---|---|---|
| Example 6 | 29.5 | 5.70 |
| | 29.1 | 8.30 |
| Example 7 | 25.2 | 5.60 |
| | 27.1 | 8.10 |
| Example 8 | 27.3 | 4.30 |
| | 25.7 | 6.70 |
| Example 9 | 23.2 | 2.80 |
| | 21.6 | 4.20 |
| | 22.0 | 5.50 |
| | 24.7 | 8.90 |

The water treated control is 19.6 Specific Tensile Stiffness.

EXAMPLES 10–15

20 The procedure of Example 1 is again followed except that various component ratios of the compositions are employed as follows:

Example 10—untreated paper

Example 11—100% starch

Example 12—70% starch and 30% polymer of Example 1

Example 13–70% starch, 22.5% polymer of Example 1 and 7.5% glyoxal*

Example 1470% starch, 15% polymer of Example 1 and 15% gloyxal*

Example 15—70% starch, 7.5% polymer of Example 1 and 22.5% glyoxal*

The results are set forth in Table III, below. *=no reaction product of glyoxal and polymer present

TABLE III

| Composition of | Specific Tensile Stiffness (in millions) (in.) | Total Solids Pick-Up (%) |
|---|---|---|
| Example 10 | 20.5 | 2.8 |
| | 20.5 | 7.0 |
| Example 11 | 20.9 | 2.8 |
| | 21.6 | 7.0 |
| Example 12 | 23.1 | 2.8 |
| | 23.8 | 7.0 |
| Example 13 | 22.9 | 2.8 |
| | 25.2 | 7.0 |
| Example 14 | 24.7 | 2.8 |
| | 26.7 | 7.0 |
| Example 15 | 23.0 | 2.8 |
| | 24.7 | 7.0 |

EXAMPLE 16

The procedure of Example 1 is again followed except that the copolymer is replaced by an equivalent amount of polyacrylamide. Similar results are achieved.

EXAMPLE 17

Again following the procedure of Example 1, except that the copolymer is comprised of 80% of acrylamide and 20% of dimethylaminoethyl acrylate, excellent results are observed.

EXAMPLES 18–21

The procedure of Examples 2–5 are again followed except that the added composition is produced in accordance with U.S. Pat. No. 3,556,932 using an excess of the acrylamide copolymer. The resultant product is called Product A. The results are set forth in Table 12, below.

Example 18—100% starch

Example 19—80% starch; 20% Product A

Example 20—60% starch; 40% Product A

Example 21—40% starch; 60% Product A

TABLE IV

| Composition of | Specific Tensile Stiffness (in millions) (in.) |
|---|---|
| Example 18 | 24.1 |
| Example 19 | 25.6 |
| Example 20 | 27.1 |

TABLE IV-continued

| Composition of | Specific Tensile Stiffness (in millions) (in.) |
|---|---|
| Example 21 | 26.5 |

EXAMPLES 22-25

Following the procedure of Examples 18-21 except that the unreacted mixture of acrylamide copolymer and glyoxal of Example 1 are employed, the results set forth in Table V are achieved.

Example 22—100% starch

Example 23—80% starch; 20% Product of Example 1

Example 24—60% starch; 40% Product of Example 1

Example 25—40% starch; 60% Product of Example 1

TABLE V

| Composition of | Specific Tensile Stiffness (in millions) (in.) |
|---|---|
| Example 22 | 27.1 |
| Example 23 | 29.3 |
| Example 24 | 30.6 |
| Example 25 | 30.9 |

As can be seen on directly comparing Examples 18-21 with Examples 22-25, the products of the instant invention, in each instance, provide a greater increase in stiffness to paper as represented by the Specific Tensile.

I claim:

1. A method of stiffening paper which comprises (A) adding to paper at the size press end of a paper-making machine, with or without starch, an effective amount of a composition consisting essentially of an aqueous solution of:

(1) a water-soluble polymer of acrylamide and (2) glyoxal the ratio of (1):(2) ranging from about 90:10 to about 25:75, respectively, (B) drying the resultant paper and (C) recovering the resultant stiffened paper sheet.

2. A method according to Claim 1 wherein said polymer of acrylamide is a copolymer containing up to about 20%, by weight, based on the total weight of the copolymer, of a monomer copolymerizable therewith.

3. A method according to Claim 2, wherein said polymer of acrylamide is a copolymer of acrylamide and acrylic acid.

4. A method according to Claim 3 wherein said copolymer contains from about 50-99%, by weight, of acrylamide and from about 1-50%, by weight, of acrylic acid.

5. A method according to Claim 1 wherein said polymer of acrylamide has a molecular weight ranging from about 10,000 to about 5,000,000.

6. A method according to Claim 1 wherein said composition is added to the paper sheet in conjunction with from about 10% to about 95%, by weight, based on the total weight of the composition, of starch.

7. Paper produced by the method of Claim 1.

8. Paper produced by the method of Claim 2.

9. Paper produced by the method of Claim 3.

10. Paper produced by the method of Claim 4.

11. Paper produced by the method of Claim 5.

12. Paper produced by the method of Claim 6.

* * * * *